US008613645B2

(12) United States Patent
Wiederhold et al.

(10) Patent No.: US 8,613,645 B2
(45) Date of Patent: Dec. 24, 2013

(54) HONING TOOL

(75) Inventors: Joachim Wiederhold, Schorndorf (DE); Henning Klein, Stuttgart (DE)

(73) Assignee: KADIA Produktion GmbH + Co. (DE)

( * ) Notice: Subject to any disclaimer, the term of this patent is extended or adjusted under 35 U.S.C. 154(b) by 42 days.

(21) Appl. No.: 12/838,072

(22) Filed: Jul. 16, 2010

(65) Prior Publication Data

US 2011/0223843 A1 Sep. 15, 2011

(30) Foreign Application Priority Data

Mar. 9, 2010 (DE) ..... 20 2010 003 782 U

(51) Int. Cl.
*B24B 5/40* (2006.01)

(52) U.S. Cl.
USPC ..... 451/470; 451/51; 451/61; 451/472; 451/473; 451/478; 451/484; 451/486

(58) Field of Classification Search
USPC ..... 451/51, 61, 464, 470, 471, 472, 473, 451/474, 475, 476, 477, 478, 484, 485, 486
See application file for complete search history.

(56) References Cited

U.S. PATENT DOCUMENTS

| | | | | | |
|---|---|---|---|---|---|
| 1,499,556 | A | * | 7/1924 | Sargent | 451/474 |
| 1,863,042 | A | * | 6/1932 | Floss | 451/474 |
| 1,924,865 | A | * | 8/1933 | Kowalski | 451/474 |
| 2,340,767 | A | * | 2/1944 | Prange | 451/479 |
| 2,657,506 | A | * | 11/1953 | Hadley et al. | 451/485 |
| 2,823,498 | A | * | 2/1958 | Saunders | 451/540 |
| 2,952,952 | A | | 9/1960 | Stanhope | |
| 3,037,333 | A | * | 6/1962 | Stelmachowski | 451/478 |
| 3,403,481 | A | * | 10/1968 | McDonald | 451/540 |
| 3,641,715 | A | * | 2/1972 | Kramm et al. | 451/540 |
| 3,672,102 | A | * | 6/1972 | Johnson | 451/540 |
| 3,711,260 | A | * | 1/1973 | Kramm et al. | 451/540 |
| 3,810,333 | A | * | 5/1974 | Gillette | 451/470 |
| 3,871,140 | A | * | 3/1975 | Kramm et al. | 451/470 |
| 4,471,576 | A | | 9/1984 | Corley | |
| 5,957,766 | A | | 9/1999 | Kalokhe et al. | |

FOREIGN PATENT DOCUMENTS

| | | | |
|---|---|---|---|
| DE | 8806992 | U1 | 8/1988 |
| DE | 29616300 | U1 | 10/1996 |
| DE | 29921053 | U1 | 1/2000 |
| WO | 01/39926 | A1 | 6/2001 |

OTHER PUBLICATIONS

European Search Report issued Dec. 7, 2012 in connection with EP 11 00 1099.

* cited by examiner

*Primary Examiner* — Timothy V Eley
(74) *Attorney, Agent, or Firm* — Akerman LLP

(57) ABSTRACT

A honing tool comprises a tubular tool body fastened with an end section in a tool shank and a cutting region on an opposite end section with at least one honing-stick accommodating opening. The dimensions of the honing-stick accommodating opening and of the honing stick are matched to one another so that the honing stick is accommodated in a radially movable manner, and essentially free of play in a circumferential direction of the tool body, between boundary surfaces of the honing-stick accommodating opening. A play-compensating device between the honing stick and the honing-stick accommodating opening comprises at least one elastically deformable supporting element which is supported with a pressure force, in a fitted state of the honing stick, on one hand on a side surface of the honing stick and on the other hand on a boundary surface, opposite the side surface, of the honing-stick accommodating opening.

18 Claims, 2 Drawing Sheets

HONING TOOL

The following disclosure is based on German Utility Application No. 20 2010 003 782.4 filed on Mar. 9, 2010, which is incorporated into this application by reference.

BACKGROUND OF THE INVENTION

The invention relates to a honing tool for machining cylindrical bores.

Honing is a cutting process using geometrically undefined cutting edges, in which a honing tool performs a cutting movement consisting of two components and there is constant surface contact between one or more cutting material bodies of the honing tool and the internal bore surface to be machined. The kinematics of an expandable honing tool are characterized by superimposition of a rotary movement, of a stroke movement running in the axial direction of the bore and of an infeed movement which leads to a change in the effective diameter of the honing tool. A surface structure with intersecting finishing marks is obtained on the internal bore surface. Surfaces finish-machined by honing can satisfy extremely high requirements with regard to dimensional and geometrical tolerances, and so many highly loaded sliding surfaces in engines or engine components, e.g. cylinder faces in engine blocks or internal bore surfaces in housings of injection pumps, are machined by honing.

Especially during the machining of bores having relatively small diameters, for example a diameter of around 15 mm or less, honing tools which have a tubular tool body are used, the tool body being fastened with one end section in a tool shank and having at the opposite end section a cutting region having at least one honing-stick accommodating opening which is continuous from the interior of the tool body to the outside and is intended for accommodating a honing stick. The tool body serves in this case as a holder for one or more honing sticks and at the same time as a guide for an infeed rod which is used for the radial infeed of the honing sticks. The tool shank serves on the one hand for accommodating the tool body and on the other hand for fastening the honing tool to the work spindle of a honing machine.

The dimensions of the honing-stick accommodating opening, which is rectangular as a rule, and the corresponding cross-sectional dimensions of the honing stick are matched to one another in such a way that the honing stick is accommodated in a radially movable manner, and essentially free of play in the circumferential direction of the tool body, between boundary surfaces of the honing-stick accommodating opening. As a rule, it is attempted in this case to realize a sliding fit by exact machining of the boundary surfaces of the honing-stick accommodating opening and the corresponding side surfaces of the honing stick, such that the honing stick can only just be inserted manually into the honing-stick accommodating opening and is held there by static friction forces between side surfaces of the honing stick and the adjoining boundary surfaces of the honing-stick accommodating opening.

The inner side of the honing stick, which inner side projects into the interior of the tool body, has as a rule a sloping surface which interacts with a sloping surface at the end of the infeed rod like a wedge drive in such a way that an axial displacement of the infeed rod to that end of the tool body which is remote from the spindle displaces the honing stick radially outwards. DE 299 21 053 U1 shows examples of such honing tools.

Honing tools of this type are very reliable and guarantee the best machining results. After a prolonged service life, however, damage to the honing stick can be observed every now and then, this damage partly being recognized as one-sided wear of the cutting layer. In individual cases, it was also observed after a prolonged service life that honing sticks can jam in the honing-stick opening. A situation can also occur in which honing sticks fall out of the honing-stick accommodating opening after a prolonged service life when the honing tool is withdrawn from the machined bore. In order to prevent the honing sticks from falling out of honing tools, what are referred to as stick catch bushes are used in some cases. These are essentially sleeve-shaped components which are guided in a slidable manner on the tool body above the cutting region and are displaced, on account of their dead weight, over the cutting region with the honing sticks when the honing tool is withdrawn from the bore. This prevents honing sticks from falling out and any possible difficulties are avoided when inserting the honing tool into the next bore to be machined.

SUMMARY OF THE INVENTION

One object of the invention is to provide a honing tool of the type in question which functions reliably even after a prolonged service life and can have a longer service life than conventional honing tools of a similar type of construction. The improved functionality is to be achievable with relatively simple design measures.

As a solution to this and other objects the invention, according to one formulation, provides a honing tool comprising:

a tubular tool body fastened with an end section in a tool shank and having on an opposite end section a cutting region with at least one honing-stick accommodating opening, which is continuous from an interior of the tool body to an outside of the tool body and accommodates a honing stick, wherein dimensions of the honing-stick accommodating opening and of the honing stick are matched to one another in such a way that the honing stick is accommodated in a radially movable manner, and essentially free of play in a circumferential direction of the tool body, between boundary surfaces of the honing-stick accommodating opening; and a play-compensating device which is effective between the honing stick and the honing-stick accommodating opening;

the play-compensating device comprising at least one elastically deformable supporting element which is supported with a pressure force, in a fitted state of the honing stick, on the one hand on a side surface of the honing stick and on the other hand on a boundary surface, opposite the side surface, of the honing-stick accommodating opening.

Advantageous developments are specified in the dependent claims. The wording of all the claims is made by reference to the content of the description.

Detailed investigations have shown that hitherto unnoticed wear mechanisms can occur on honing tools of the type in question, and these wear mechanisms can limit the service life of the honing tools. When manufacturing new tools, care is taken to ensure that a clear distance between boundary surfaces of the honing-stick accommodating opening facing one another and a width of the honing stick measured between corresponding side surfaces of the honing stick are matched to one another in such a way that the lateral boundary surfaces of the honing-stick accommodating opening, which are flat as a rule and lie parallel to one another, and the side surfaces of the honing stick, which face said lateral boundary surfaces and are likewise flat as a rule, form sliding partners which allow a radial displacement of the honing stick within the honing-stick accommodating opening during the infeed, although the static friction is to be sufficiently high so that a honing stick, once inserted, can no longer fall out of the honing-stick accommodating opening. When the honing tool is being used, however, wear phenomena which are produced by the movement of the honing stick within the honing-stick accommodating opening during the honing operation can occur at the sliding surfaces interacting with one another. In the process, honing sludge, for example, that is to say a mixture of cooling lubricant and extremely fine abrasion particles of the honing operation, can be deposited in the gaps and can lead to increased abrasive wear. The honing stick can become slightly narrower and/or the honing-stick accommodating opening can become slightly wider where this wear mechanism takes effect, such that the play between these elements increases during the service life of the tool. This can lead during the rotary movement of the honing tool to slight tilting of the honing sticks from the desired radially oriented nominal position, which in turn can lead to one-sided wear of the cutting layer and possibly to results at the inner wall of the bore that are less than ideal. Finally, the loss of the relatively tight fit of the honing stick in the honing-stick accommodating opening can lead to the honing stick falling out of the bore during the withdrawal of the honing tool if no countermeasures are taken.

Such problems are removed by the play-compensating device since the play, possibly increasing during use, between honing stick and honing-stick accommodating opening is eliminated from the fit at all times via the supporting element, thereby bridging developing tolerances. In this case, the elastically deformable supporting element is preloaded in a slightly deformed state, such that, even if the distance between honing-stick side surface and boundary surface increases, reliable support on both sides is obtained and the honing stick is reliably held in place in the honing-stick accommodating opening. The clearance of motion of the honing stick in the honing-stick accommodating opening is restricted by the play-compensating device to such an extent that at least some of the hitherto effective wear mechanisms cannot act or can only act in a greatly alleviated form. As a result, the wear on the honing tool is reduced and the potential consequences of wear-induced changes in the geometries are compensated for, and therefore the problems associated therewith previously no longer occur or only occur in a greatly alleviated form.

In preferred embodiments, the honing stick has a recess on at least one side surface in a guide section intended for interaction with the honing-stick accommodating opening, and arranged in the recess is an elastically deformable supporting element which projects beyond the side surface of the honing stick in the relieved, i.e. non-deformed, state and which, in the fitted state of the honing stick, is partly deformed and is supported with a pressure force on a boundary surface, opposite the side surface, of the honing-stick accommodating opening. In this configuration, all the design changes required for providing the play-compensating device, compared with conventional honing tools, can be realized on the honing stick. As a result, it is possible to provide novel honing sticks which, by being fitted in conventional tool bodies, enable honing tools with improved properties to be produced. Such honing sticks can be used not only when manufacturing new honing tools but also when retrofitting conventional honing tools. Honing sticks of this type can also be used during the maintenance and repair of already used honing tools of the type in question.

In some embodiments, the supporting element is an element which is made at least partly, but preferably completely, of an elastically compressible material, in particular an elastomer material or a rubber material. Designated as an elastomer here is a dimensionally stable, but elastically deformable, plastic, as is used, for example, for sealing elements of various design. Rubber materials can be produced on the basis of vulcanized natural rubber. Supporting elements made of elastically compressible materials are inexpensive to produce, are obtainable in numerous useful sizes and cross-sectional shapes and have as a rule long-lasting resistance under normal machining conditions to all coolants and lubricants used during honing.

Alternatively or additionally, at least one supporting element can be a spring element which can preferably be made of a metallic material, for example a suitable spring steel, inter alia for reasons of durability. The spring element can be configured, for example, in the form of a leaf spring.

In some embodiments, the recess is a groove, i.e. an elongated depression, in a side surface of the honing stick and the supporting element is an elongated element which extends over at least part of the length of the groove, in particular over the entire length of the groove. Elongated recesses in the form of grooves can be produced in a honing stick in a very simple manner and with any suitable cross-sectional shapes by milling or grinding. It is also possible to provide a recess for an elastically deformable supporting element directly during the manufacture of the honing stick, such that a material-removing machining step can be saved. For example, a recess can be produced during the sintering of a sintered honing stick body by the corresponding moulding tool having a corresponding stick-like projection at the desired location of the recess.

The elongated elastic supporting elements used can be sections of conventional sealing strips or other sealing elements. Support along a linear supporting region is possible due to the elongated configuration of recess and supporting element, as a result of which the tendency of the honing stick to tilt can be reduced. A plurality of supporting elements or supporting element segments can be accommodated in a groove. Preferably only a single supporting element is accommodated in a groove, it being possible for this single supporting element to extend over the entire length of the groove.

It is often especially favourable if the groove extends over the entire length of the side surface and if the supporting element is an elongated element made of an elastically compressible material and likewise extends over the entire length of the side surface. In this way, the play-compensating device can at the same time act as a sealing device which, for example, prevents the ingress of honing sludge or lubricant from outside into the interior of the tool body over the entire width or length of the compressed supporting element.

In some embodiments, the elongated supporting element has a round cross-sectional shape, in particular a circular or elliptical cross-sectional shape, in the non-deformed state. Such elements are also durable under rough environmental conditions and, given suitable oversize of the recess, can roll back and forth in the latter to a limited extent, as a result of which the radial mobility of the honing stick can be assisted. It is also possible for the supporting element to have a polygonal cross-sectional shape, in particular a rectangular shape or a triangular shape, in the non-deformed state. Other cross-sectional profiles of elastic supporting elements are also possible.

The groove preferably has a rounded groove shape, i.e. a cross-sectional shape without corners. The clear width of the groove can decrease continuously with increasing depth, and so this can be a groove open towards the side surface and without an undercut. Supporting elements having a round cross-sectional shape and slight undersize relative to the larger groove can, if need be, roll to a limited extent in grooves shaped in this way in order to ensure the radial mobility of the honing stick.

As a rule, it is favourable if a play-compensating device is provided only on one of two side surfaces, running perpendicularly to the rotation direction of the honing tool, of the honing stick. On a corresponding honing stick, this can normally be recognized by the fact that a recess is provided in one of two parallel longer side surfaces of the honing stick. This side surface is preferably that side surface of the honing stick which leads in the rotation direction of the honing tool. A play-compensating device provided on one side is firstly more favourable in production than a play-compensating device on both sides. In addition, a play-compensating device on one side ensures that there is direct contact on the opposite side surface between the hard boundary surface of the honing-stick accommodating opening and the likewise hard side surface of the honing stick, such that the position of the honing stick is defined relative to the honing-stick accommodating opening. As a result, the risk of tilting of the honing stick within the honing-stick accommodating opening can be countered, especially since, during rotation of the honing tool, the force resulting from the machining acts as contact force on this surface.

An even more advantageous effect can be obtained when using elastically compressible materials for supporting elements. Firstly, the elasticity or compressibility of the material between the side surface of the honing stick and the opposite boundary surface acts for the purposes of play compensation in order to largely prevent relative movement perpendicularly to the sliding surfaces. Secondly, a relative displacement between honing stick and honing-stick opening occurs in the radial direction during radial infeed of the honing sticks, such that the elastomeric material clamped in place in between is subjected to transverse forces which fold or flex the material. This gives rise to elastic restoring forces which want to achieve a retraction movement or haul-in movement of the honing sticks against the force of the infeed acting from inside. If the infeed rod is retracted in order to relieve the honing sticks, the elastically deformed supporting element can serve as a honing-stick draw-in device for drawing in the honing stick during the retraction of the infeed rod or another infeed device. As a rule, return travel in the order of magnitude of only a few micrometers is sufficient in order to facilitate the withdrawal of the honing tool from the machined bore and in order to avoid damage to honing stick and/or internal bore surface. Corresponding advantages can also be obtained when inserting the tool into a new bore.

The invention therefore also provides a honing tool of the type in question which is characterized by a honing-stick draw-in device for drawing in the honing stick during retraction of an infeed device. In contrast to the conventional stick catch bushes, which press the honing sticks into the honing-stick opening from outside, a retraction force acting from inside becomes effective here. Stick catch bushes can therefore be dispensed with.

These and further features are apparent from the description and the drawings as well as from the claims, wherein each individual feature can be realized on its own or a plurality thereof can be realized in the form of sub-combinations in an embodiment of the invention and in other fields and can constitute advantageous embodiments patentable on their own. Exemplary embodiments are shown in the drawings and are explained in more detail below.

DETAILED DESCRIPTION OF THE PREFERRED EMBODIMENTS

Figure 1:
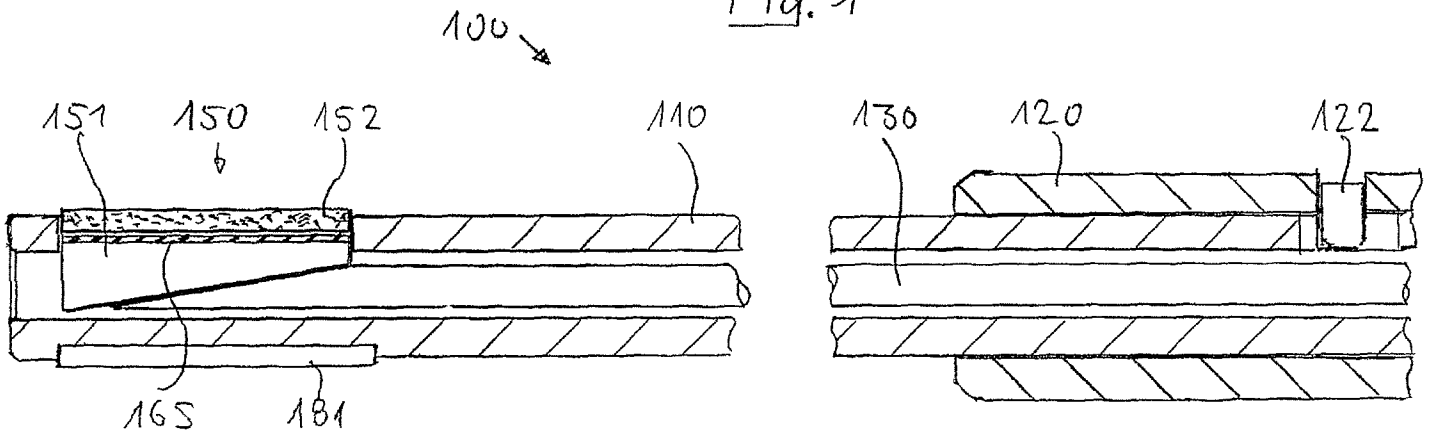
FIG. 1 shows a section through an embodiment of a honing tool running parallel to the rotation axis of the honing tool.

FIG. 1 shows a longitudinal section through an embodiment of a honing tool 100, designed as a single-stick honing tool, parallel to the tool axis (rotation axis) (which cannot be seen in the sectional illustration) of the honing tool. The honing tool has a tool body 110 in the form of a tube open on both sides and having a relatively large wall thickness, which is more than 20% of the outside diameter of the tube. An end section of the tool body made of a steel material is inserted in a rotationally fixed manner into a cylindrical accommodating opening of a tool shank 120 and is fixed there by means of a retaining screw 122. The tool shank 120 serves to couple the honing tool to a honing spindle of a machine tool. The tool shank and the tool body can also be connected to one another in another way in a detachable or non-detachable manner, for example by clamping in place (cf. DE 299 21 053 U1), by brazing or the like.

Figure 2:
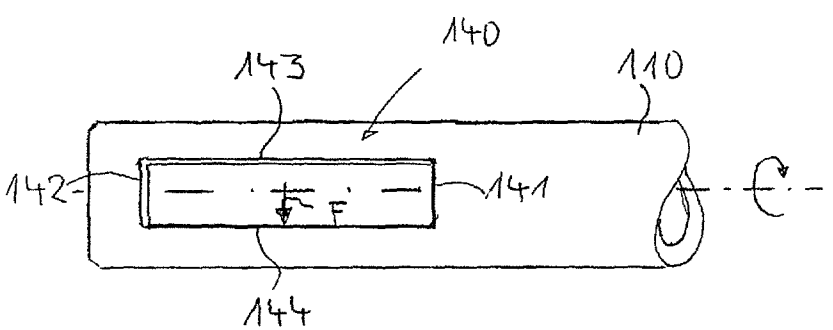
FIG. 2 shows a lateral plan view of a tubular tool body having a rectangular honing-stick accommodating opening.
Figure 3:
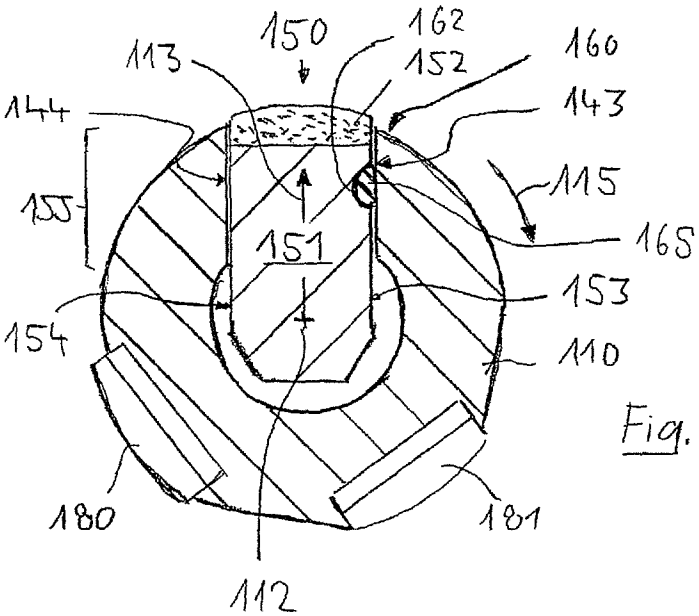
FIG. 3 shows a section, taken perpendicularly to the tool axis, through the cutting region, provided with a honing stick, of the honing tool from FIG. 1.

The cutting region of the honing tool is located in a free end section of the tool body opposite the tool shank, said cutting region, for the honing operation, being inserted into the interior of a bore to be machined. As can be seen especially clearly in FIG. 2, the tool body has, in the cutting region, a rectangular honing-stick accommodating opening 140 which is continuous from the interior of the tool body to the outside and in which a honing stick 150 is accommodated in an accurately fitting manner when the honing tool is assembled (cf. FIG. 1 or 3). The honing-stick accommodating opening has four flat boundary surfaces parallel to one another in pairs, namely a top (as viewed in axial direction) boundary surface 141, a bottom boundary surface 142 running parallel thereto, and two longer lateral boundary surfaces 143 and 144 which run perpendicularly to said shorter boundary surfaces and of which the boundary surface leading in the rotation direction 115 is designated as front boundary surface 143 and the boundary surface trailing in the rotation direction is designated as rear boundary surface 144. The front and the rear boundary surfaces are each flat and run parallel to a plane which is defined by the tool axis 112 and a radial direction 113 running centrally between the lateral boundary surfaces.

On the side opposite the honing-stick accommodating opening 140, two supporting sticks 180, 181 circumferentially offset from one another by about 90° and having radial outer surfaces made of carbide or another hard, e.g. ceramic, material are attached to the tool body.

The honing stick 150, which is plate-shaped overall, has a plate-shaped backing element 151 made of steel, to the radial outer side of which a cutting layer 152 is applied, which contains bonded cutting material grains. In the example, the layer is sintered onto the backing, but in other embodiments can also be adhesively bonded in place or brazed in place or fastened by riveting or screwing to the backing element. A honing stick can also be formed by a one-piece sintered body.

A radial inner side of the backing element has a flat sloping surface, which interacts with a complementary flat sloping surface on the bottom end of an infeed rod 130, guided in the tool body, like a wedge drive in such a way that the honing stick is pressed radially outwards inside the honing-stick accommodating opening when the infeed rod is pressed in the direction of the cutting region of the honing tool by the infeed drive accommodated in the honing machine. Such honing sticks are occasionally referred to as "honing stick with expanding profile".

That section of the honing stick which lies between the lateral boundary surfaces 143, 144 of the honing-stick accommodating opening in the fitted state and which is guided by these surfaces during the radial movement is designated as guide section 155. The guide section includes part of the backing element 151 and a relatively small part of the cutting layer. The dimensions of the honing stick and of the honing-stick accommodating opening are matched to one another in such a way that the honing stick is accommodated in a radially movable manner, but essentially free of play in the circumferential direction of the tool body, between the lateral boundary surfaces 143, 144. Slight play may be present in the axial direction, i.e. between the top and the bottom boundary surfaces. As a rule, however, it is also attempted to achieve in the axial direction a fit that as far as possible is free of play. During manufacture, care is taken to ensure that the clear distance between the front and the rear boundary surfaces 143, 144 of the honing-stick accommodating opening is only very slightly larger than the width of the honing stick measured between the front side surface 153 and the rear side surface 154 of the honing stick. In the most favourable case, a relatively tight sliding fit is to be obtained, such that the honing stick can certainly be pressed manually into the honing-stick accommodating opening during assembly, but can no longer fall out of the honing-stick accommodating opening by itself. However, the honing stick is to be capable of being displaced radially outwards under the effect of the infeed rod pressed downwards.

A special feature of the honing tool consists in the fact that a play-compensating device 160 is provided which acts between the honing stick 150 and the honing-stick accommodating opening 140 and is designed in such a way that any play between the honing-stick accommodating opening and the honing stick accommodated therein is permanently compensated for even if the geometrical relationships described above (sliding fit) should change on account of wear or due to other causes. In the embodiment, this is achieved very simply, but very effectively, from the design point of view. In the guide section, directly below the cutting layer, the honing stick has an elongated recess 162 in the form of a groove which extends over the entire length of the front side surface 153 and parallel to the cutting layer. The groove 162 has a rounded, approximately semicircular cross section. The groove width is less than 50%, in particular less than 40% or less than 30%, of the radial width of the guide section, such that the groove is always located fully opposite the opposite front boundary surface 143 within the entire radial adjusting range of the honing stick.

Lying in the groove 162 is an elastically deformable supporting element 165, which is an elongated element of round cross section made of an elastomer material. The supporting element can be formed, for example, by a section of an O-ring or of a similar conventional sealing element. The diameter of the supporting element is approximately twice as large as the depth of the groove 162 provided for accommodating it, and therefore approximately half the supporting element projects beyond the front side surface 153 when the supporting element is completely fitted into the groove and is fastened there, if need be, by adhesive bonding or in another way. The elastically compressible supporting element fills the groove 162 over its entire length, such that the gap which can be formed between the front side surface 153 of the honing stick and the opposite front boundary surface 143 of the honing-stick accommodating opening is largely sealed off in the radial direction by the compressible material when the honing stick is inserted into the honing-stick accommodating opening.

During assembly, first of all the supporting element 165 is inserted into the groove 162 and is fixed there, if need be, by adhesive bonding or the like. The honing stick is then pressed into the honing-stick accommodating opening from outside. In the process, the supporting element is compressed to a considerable degree as soon as the groove reaches the region of the honing-stick accommodating opening. During insertion, the supporting element is compressed and fills the groove 162 and the space between the side surface 153 provided with the groove and the front boundary surface 143. The elastic forces within the supporting element ensure that the honing stick is firmly pressed with its rear side surface 154 against the rear boundary surface 144, and therefore no gap affected by play remains between the sliding partners of the sliding pair there. If a gap arises, this is the case between the corresponding surfaces 143, 153 of the front sliding pair, which if need be are pushed apart by the supporting element. Nonetheless, on account of the pressure-loaded contact between the rear plane surfaces 154, 144, the honing stick reliably maintains its radial orientation and cannot tilt. This pressure force F (see arrow) is even intensified when the honing tool rotates in rotation direction 115 during the machining in the bore and the cutting pressure additionally presses the honing stick against the rear boundary surface 154.

The play-compensating device 160 is attached only on one side of the honing stick, namely on that side which leads in the rotation direction 115 during rotation of the honing tool. This achieves the effect that two flat, hard surfaces 144, 154 bear on one another at the opposite sliding pair, and so the honing stick always has a defined position during the machining. Tilting of the honing stick is thus reliably avoided. Avoiding tilting of the honing stick means in turn that the honing stick is also constantly radially oriented in an optimum manner during the machining and therefore the cutting layer is worn down evenly. This results in a noticeable increase in the service life of the tools. Furthermore, the play-compensating device protects the honing stick from falling out of the tool body, and so separate retention devices, such as, for example, a stick catch bush, are not necessary.

If the honing stick is fed in outwards in the radial direction by means of the infeed rod during the machining, the elastomer material is deformed by the infeed movement and the structure of the elastomer material is distorted by transverse deformation. If the infeed rod is retracted after the honing operation is complete, the elastic restoring forces within the supporting element can produce a restoring force on the honing stick, and this restoring force retracts the honing stick radially inwards. As a rule, the return travel is only a few micrometers, for example between two micrometers and thirty micrometers. However, this is sufficient in order to counteract the applied pressure between cutting layer and internal bore surface to such an extent that the honing tool can be withdrawn from the workpiece without risk and without damaging the honed internal surface. The elastically deformable supporting element therefore has a double function here, since it also acts as a restoring element of a draw-in device of the honing stick for drawing in the honing stick during the retraction of the infeed rod.

Figure 4:
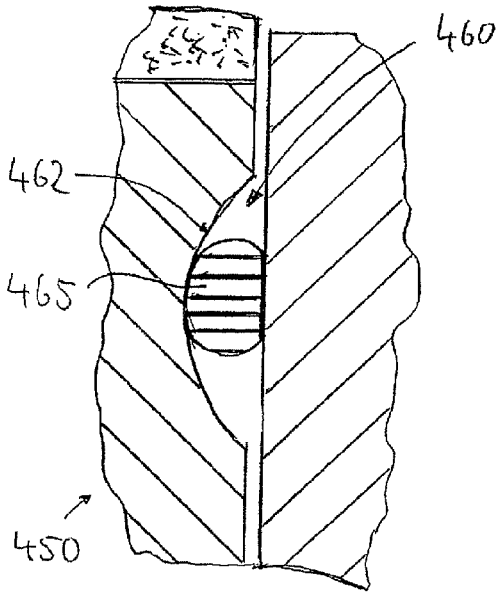
FIG. 4 shows a schematic detailed illustration of a play-compensating device in another embodiment.
Figure 5:
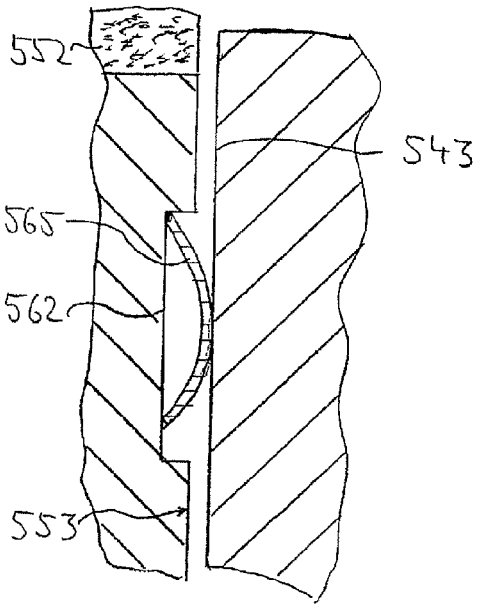
FIG. 5 shows a schematic detailed view of a play-compensating device having a leaf spring element which is fastened in a recess of the honing stick.
Figure 6:
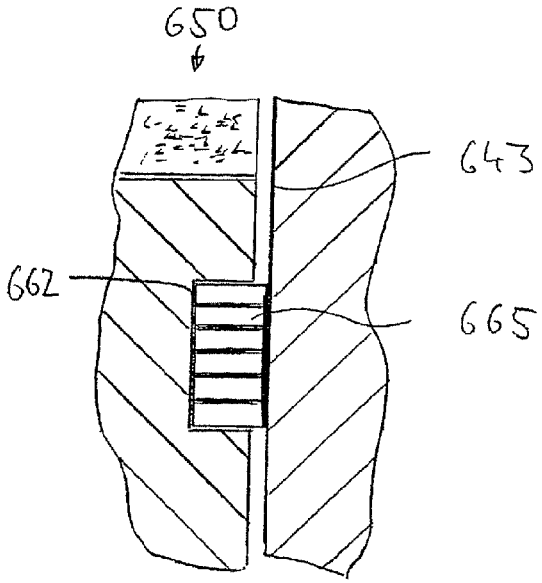
FIG. 6 shows a schematic detailed illustration of a play-compensating device in another embodiment.

Some of numerous variants are schematically shown in FIGS. 4 to 6. FIG. 4 shows an enlarged detail of a honing tool having a play-compensating device 460 which has a groove 462 which runs in the longitudinal direction of the honing stick 450 below the cutting layer 452 and in which a continuous, long, elastically compressible supporting element 465 lies. In the relieved state, the latter has a circular cross section and can be formed, for example, by a section of an O-ring of suitable dimensions. In contrast to the embodiment in FIG. 3, the groove 462 has a wider cross section, which appears flatter and results from the fact that the radius of curvature of the groove cross section is substantially larger than the radius of curvature of the cross section of the supporting element. As a result, it is possible for the supporting element 465 to roll in the radial direction within the relatively wide groove 462 if the honing stick is advanced radially outwards from the inside by the infeed rod. This is because the compressed supporting element moves into the region of the groove edge on the side remote from the cutting layer, said region becoming increasingly narrower. The supporting element is increasingly compressed during the rolling movement. If the infeed rod is then retracted, the supporting element can be relieved of pressure or can relax by virtue of the fact that it attempts to roll back into the position of equilibrium shown in FIG. 4. As a result, a restoring force directed radially inwards is exerted on the honing stick.

In the embodiment in FIG. 5, a rectangular recess 562 is made in the front side surface 553 of the honing stick 550, and this rectangular recess 562 can be continuous over the entire length of the honing stick or can also take up only part of the length. One end of a thin leaf spring 565 made of spring steel is fastened by spot welding, or in another way, in the top region, facing the cutting layer 552, of the recess 562. The leaf spring is convexly curved with respect to the base of the recess 562 and is supported with its free end on the flat base of the recess 562. The leaf spring is dimensioned in such a way that the curved central section of the leaf spring projects beyond the side surface 553 in the relieved, non-deformed state in such a way that the leaf spring, when the honing stick is inserted into the honing-stick opening, is slightly deformed by the contact with the front boundary surface 543 of the honing-stick accommodating opening and as a result the honing stick and the opposite boundary surface 543 of the honing-stick opening are pressed apart in such a way that any play present is compensated for.

In the embodiment in FIG. 6, the supporting element 665 made of an elastomer material has a rectangular cross section, in particular a square cross section, and rests in an accurately fitting manner in a rectangular groove 662 of the honing stick 650. With a boundary surface which is flat from the outset, the supporting element bears against the opposite flat boundary surface 643 over a large surface area and reliably seals off this region. When an elastic deformation of the supporting element has built up after displacement of the honing stick radially outwards, the restoring forces which lead to the return of the honing stick after the load relief of the infeed system are especially high in this embodiment.

Embodiments of the invention have been explained with reference to single-stick honing tools, that is to say honing tools having only a single honing stick. A honing tool may also have more than one honing stick, for example two or three or four honing sticks, in which case the honing sticks can be distributed uniformly or non-uniformly over the circumference of the honing tool. Instead of a single supporting element, a play-compensating device or a honing-stick draw-in device can also have more than one elastically deformable supporting element, for example three, four, five or six or more. A great advantage of the embodiments described is that the elements of the play-compensating device or the honing-stick draw-in device can also be provided in very small dimensions. Preferred embodiments of honing tools are provided for machining relatively small bores and have, for example, an effective diameter of 15 mm or less, in particular 10 mm or less. The effective diameter can typically be between about 5 mm and about 10 mm. However, the use of the concepts presented here in honing tools of larger diameters is also not ruled out.

What is claimed is:

1. A honing tool comprising:

a tubular tool body having a first end section fastened in a tool shank and having an opposite end section comprising a cutting region with at least one honing-stick accommodating opening, wherein the honing-stick accommodating opening is continuous from an interior of the tool body to an outside of the tool body and accommodates a honing stick, wherein dimensions of the honing-stick accommodating opening and of the honing stick are matched to one another in such a way that the honing stick is accommodated in a radially movable manner, and essentially free of play in a circumferential direction of the tool body, between boundary surfaces of the honing-stick accommodating opening; and a play-compensating device which is effective between the honing stick and the honing-stick accommodating opening;

wherein the honing stick comprises a recess on a side surface in a guide section configured to interact with the honing-stick accommodating opening;

the play compensating device comprises an elastically deformable supporting element arranged in the recess;

the elastically deformable supporting element projects beyond the side surface of the honing stick in a relieved state; and the elastically deformable supporting element, in a fitted state of the honing stick, is partly deformed and is supported with a pressure force on the boundary surface opposite a side surface of the honing-stick accommodating opening.

2. The honing tool according to claim 1, wherein the elastically deformable supporting element comprises an elastically compressible material selected from the group consisting of an elastomer material and a rubber material.

3. The honing tool according to claim 1, wherein the elastically deformable supporting element comprises a spring element.

4. The honing tool according to claim 1, wherein the recess is a groove in a side surface of the honing stick and the supporting element is an elongated element which extends over a part of the length of the groove or an entire length of the groove.

5. The honing tool according to claim 4, wherein the groove has a rounded groove shape, a clear width of the groove decreasing continuously with increasing depth.

6. The honing tool according to claim 4, wherein the elongated element has a round cross-sectional shape, in the non-deformed state.

7. The honing tool according to claim 6, wherein the round cross-sectional shape is a circular shape or an elliptical shape.

8. The honing tool according to claim 1, wherein the recess extends over the entire length of the side surface of the honing stick, and the supporting element is an elongated element made of an elastically compressible material and likewise extends over the entire length of the side surface.

9. The honing tool according to claim 1, wherein the play-compensating device is provided only on one of two side surfaces, running perpendicularly to a rotation direction of the honing tool, of the honing stick.

10. The honing tool according to claim 9, wherein the play-compensating device is provided only on a side surface of the honing stick which leads in the rotation direction of the honing tool.

11. The honing tool according to claim 1, wherein the elastically deformable play-compensating device also operates as a honing-stick draw-in device for drawing in the honing stick during retraction of an infeed device.

12. A honing tool comprising:

a tubular tool body having a first end section fastened in a tool shank and having an opposite end section comprising a cutting region with at least one honing-stick accommodating opening, wherein the honing-stick accommodating opening is continuous from an interior of the tool body to an outside of the tool body and accommodates a honing stick, wherein dimensions of the honing-stick accommodating opening and of the honing stick are matched to one another in such a way that the honing stick is accommodated in a radially movable manner, and essentially free of play in a circumferential direction of the tool body, between boundary surfaces of the honing-stick accommodating opening; and a honing-stick draw-in device for drawing in the honing stick during retraction of an infeed device comprising at least one elastically deformable supporting element which is supported with a pressure force, in a fitted state of the honing stick, on the one hand on a side surface of the honing stick and on the other hand on a boundary surface, opposite the side surface, of the honing-stick accommodating opening;

wherein the honing stick comprises a recess on the side surface in a guide section configured to interact with the honing-stick accommodating opening, wherein the elastically deformable supporting element is arranged in the recess, wherein the elastically deformable supporting element projects beyond the side surface of the honing stick in a relieved state, and wherein the elastically deformable supporting element, in a fitted state of the honing stick, is partly deformed and is supported with a pressure force on the boundary surface, opposite the side surface, of the honing-stick accommodating opening.

13. The honing tool according to claim 12, wherein the honing-stick draw-in device operates between the honing stick and the honing-stick accommodating opening.

14. A honing stick comprising:

a body having a plate-shape;

a radial outer side with bonded cutting material grains;

a radial inner side having a flat sloping surface to interact with a complementary flat sloping surface on a bottom end of an infeed rod of a honing tool;

a guide section with rectangular cross-section matched to a rectangular cross-section of a honing stick accommodating opening of the honing tool, the guide section formed between the radial inner side and the radial outer side of the honing stick;

a recess on a side surface in the guide section configured to interact with the honing-stick accommodating opening of the tool body of the honing tool, an elastically deformable supporting element arranged in the recess, wherein the elastically deformable supporting element projects beyond the side surface of the honing stick in a relieved state.

15. The honing stick according to claim 14, wherein the recess is a groove in the side surface of the honing stick and the supporting element is an elongated element made of an elastically compressible material which extends over a part of the length of the groove or an entire length of the groove.

16. The honing stick according to claim 15, wherein the groove has a rounded groove shape, a clear width of the groove decreasing continuously with increasing depth.

17. The honing stick according to claim 16, wherein the elongated element has a round cross-sectional shape, in a non-deformed state.

18. A honing tool comprising:

a tubular tool body having a first end section fastened in a tool shank and having an opposite end section comprising a cutting region with at least one honing-stick accommodating opening, wherein the honing-stick accommodating opening is continuous from an interior of the tool body to an outside of the tool body;

a honing stick accommodated in the honing-stick accommodating opening;

wherein dimensions of the honing-stick accommodating opening and of the honing stick are matched to one another in such a way that the honing stick is accommodated in a radially movable manner, and essentially free of play in a circumferential direction of the tool body, between boundary surfaces of the honing-stick accommodating opening;

wherein the honing stick comprises a groove on a side surface in a guide section configured to interact with the honing-stick accommodating opening, the groove extending over an entire length of the honing stick;

an elastically deformable supporting element is arranged in the groove;

the elastically deformable supporting element projects beyond the side surface of the honing stick in a relieved state; and the elastically deformable supporting element, in a fitted state of the honing stick, is partly deformed and is supported with a pressure force on the boundary surface opposite a side surface of the honing-stick accommodating opening, wherein the elastically deformable supporting element fills the entire length of the groove, such that a gap formed between the side surface of the honing stick and the opposite boundary surface of the honing-stick accommodating opening is substantially sealed off in a radial direction by the deformable material when the honing stick is inserted into the honing-stick accommodating opening.

* * * * *